United States Patent [19]

Annis, Jr.

[11] Patent Number: 4,605,456

[45] Date of Patent: Aug. 12, 1986

[54] METHOD AND APPARATUS FOR FEEDING AND TENSIONING STRAP IN A STRAPPING MACHINE

[75] Inventor: James R. Annis, Jr., Palatine, Ill.

[73] Assignee: Signode Corporation, Glenview, Ill.

[21] Appl. No.: 729,624

[22] Filed: May 2, 1985

[51] Int. Cl.[4] ..... B65B 13/22; B65B 13/24

[52] U.S. Cl. ..... 156/157; 53/399; 53/582; 100/29; 100/32; 100/33 PB; 156/212; 156/229; 156/468; 156/494; 156/495; 156/502

[58] Field of Search ..... 156/157, 159, 212, 229, 156/468, 494, 495, 502; 100/26, 29, 32, 33 PB; 53/399, 582, 589

[56] References Cited

U.S. PATENT DOCUMENTS

| | | | |
|---|---|---|---|
| 3,420,158 | 1/1969 | Kobiella | 100/32 |
| 4,011,807 | 3/1977 | Kobiella | 100/2 |
| 4,177,724 | 12/1979 | Johnson, III et al. | 100/32 |
| 4,356,685 | 11/1982 | Büttner | 53/582 |
| 4,444,097 | 4/1984 | Wehr et al. | 100/32 |

FOREIGN PATENT DOCUMENTS

| | | | |
|---|---|---|---|
| 119124 | 11/1944 | Australia | 100/32 |
| 459417 | 1/1937 | United Kingdom | 100/32 |

*Primary Examiner*—Michael Wityshyn
*Attorney, Agent, or Firm*—Dressler, Goldsmith, Shore, Sutker & Milnamow, Ltd.

[57] ABSTRACT

A method and apparatus for feeding and tensioning strap in a strapping machine is provided. The apparatus includes a rotatable feed wheel and means for rotating the feed wheel, a first pinch roll associated with the feed wheel, and a first strap pressing means for moving the pinch roll between a strap engaging position and a position wherein the strap is not engaged. Also provided is a rotatable take-up wheel and means for rotating the take-up wheel in a direction opposite to the feed wheel rotation. A second pinch roll is provided adjacent the take-up wheel and is movable between a first position for engaging the strap and a second position wherein the strap not engaged. A high tension member is mounted for rotation between the feed wheel and take-up wheel. The high tension member defines a slot for accommodating the strap and defines a strap engaging surface on the periphery of the high tension member at an end of the slot. Means are provided for rotating the high tension member to engage the strap and apply high tension to the strap.

13 Claims, 6 Drawing Figures

FIG. 1
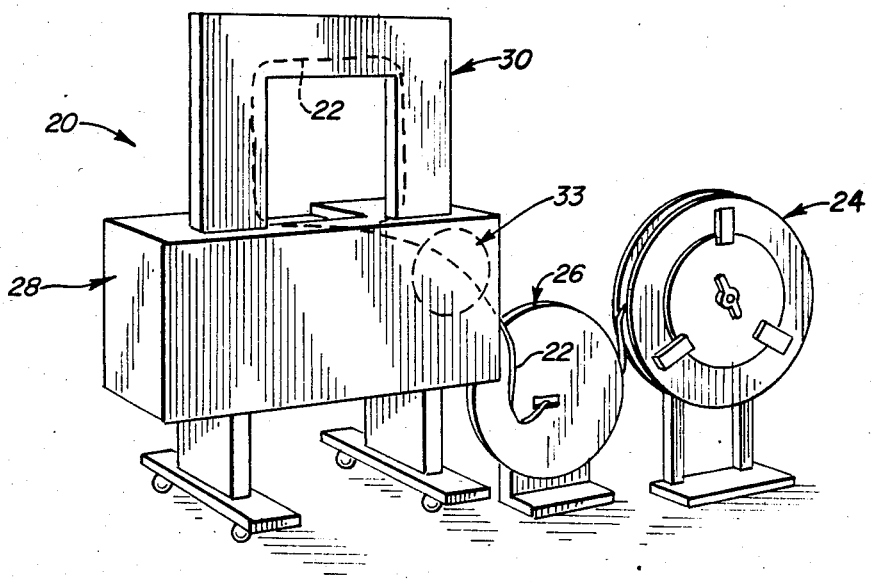
FIG. 2
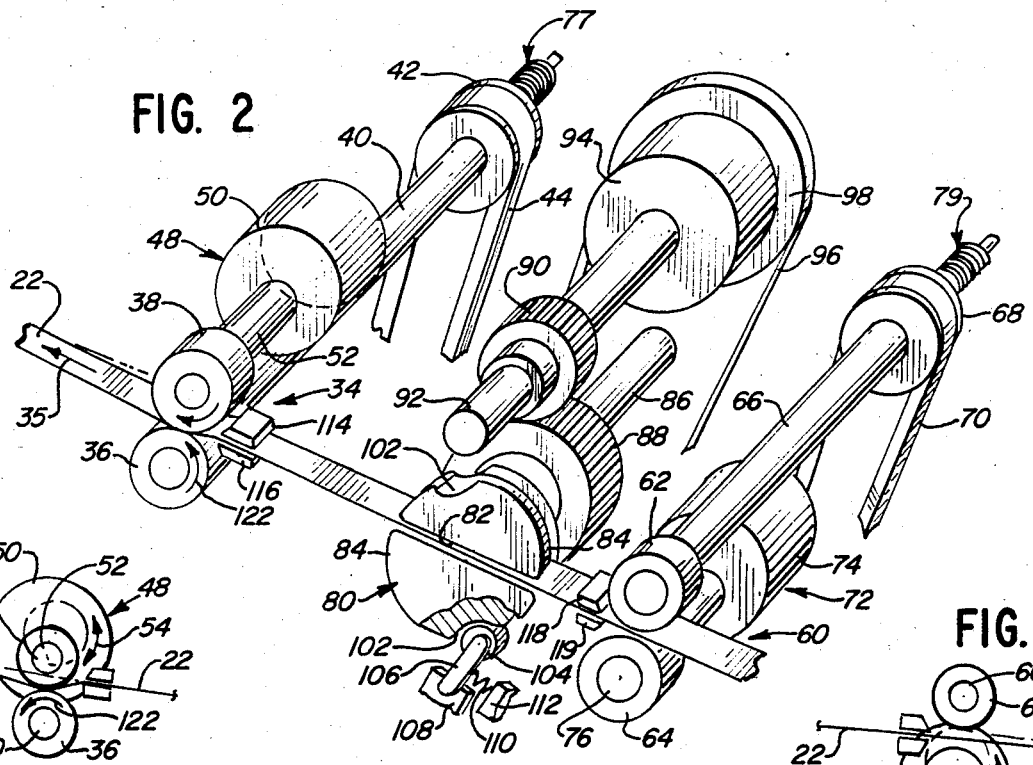
FIG. 3
FIG. 4
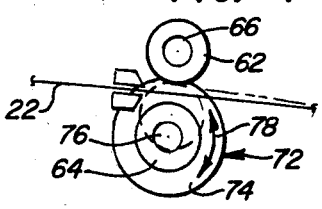

METHOD AND APPARATUS FOR FEEDING AND TENSIONING STRAP IN A STRAPPING MACHINE

TECHNICAL FIELD

This invention relates to a method and apparatus for feeding and tensioning thermoplastic strap in an automatic power strapping machine.

BACKGROUND OF THE INVENTION AND TECHNICAL PROBLEMS POSED BY THE PRIOR ART

Machines have been developed for forming a tensioned loop of thermoplastic strap around an object. Such machines typically include means for feeding strap which is automatically or manually formed into a loop about the object, means for pulling the strap loop trailing portion to tension the strap loop about the object, means for securing the overlapping strap portions together by melting and resolidifying regions of the strap, and means for severing the strap trailing portion from the loop.

A number of methods and apparatus have been developed over the years for feeding and then tensioning the strap in such machines. See, for example, the disclosures in U.S. Pat. Nos. 4,011,807 and 3,420,158 and see the following commercial automatic strapping machines (1) the "SUPERSTRAP M" machine sold in the U.S.A. by Nakano Bussan Company, 45-5, KAMATA 5-CHOME, OHATA-ku, Tokyo, 144, Japan, (2) the "MODEL MS POWER STRAPPING MACHINE" manufactured and sold in the U.S.A. by Signode Corporation, 3600 West Lake Avenue, Glenview, Ill. 60025, U.S.A., and (3) the "MCD 700/300" machine manufactured and sold in the U.S.A. by Signode Corporation, 3600 West Lake Avenue, Glenview, Ill. 60025, U.S.A. Such conventional tensioning and feeding assembly designs include a feed wheel for feeding the strap forward to form the loop and a retraction or tensioning wheel for pulling the loop tight about the object. In addition, the assembly disclosed in the U.S. Pat. No. 4,011,807 includes a rotatable winder drum with a pair of arcuate feed guide means which cause the strap to be wrapped about the drum when it is rotated so as to apply high tension to the strap loop.

Although the various conventional strap feeding and tensioning assembly designs work well for the applications for which they are intended, it would be desirable to provide an improved strap feeding and tensioning assembly which could accommodate a variety of strap feed rates and tensioning rates without "milling" or otherwise damaging the strap.

In some applications, it has been found that conventional strap feeding and tensioning assemblies do not easily accommodate an obstruction in the strap feed path. When the end of the strap being fed encounters an obstruction, it can buckle and crinkle before the machine is shut off. This can damage the strap and may thus require a new length of strap to be fed into the machine. It would be beneficial if an improved strap feeding and tensioning assembly could readily accommodate obstructions in the strap feeding path in a manner so as to prevent the strap end from being urged against the obstruction with an excessive amount of force that could cause the strap to buckle and crinkle.

In machines employing conventional high speed tensioning mechanisms to initially constrict the loop of strap about the object, the object is subjected to an initial high load when the constricting loop first contacts the package. This is because the initially formed, untensioned loop offers very little resistance to retraction of the strap until the loop is small enough to contact the periphery of the object. At that point, both the object and the strap are typically subjected to a substantially increased force as the tensioning mechanism continues to retract the strap. It would be desirable to provide an improved strap feeding and tensioning method and apparatus wherein the tension could be applied in such as way so as to reduce such initial transient impact loading (e.g., loading spikes).

Also, it would be advantageous to provide an improved strap feeding and tensioning method and apparatus of the type described wherein a relatively high tension could be applied to the strap loop after the strap loop has been initially drawn tight around the object. It would be desirable to provide such a high tension capability in a manner that would permit the use of a relatively simple high tensioning mechanism.

Finally, it would be desirable to provide the improved strap feeding and tensioning method and apparatus of the type described with the capability for very rapidly feeding the strap, rapidly withdrawing the strap tight about the object, and rapidly applying high tension to the object.

SUMMARY OF THE INVENTION

A strap feeding and tensioning assembly is provided for a strapping machine in which a length of strap can be formed into a loop about an object and in which there are means for gripping the end of the strap in the loop. The assembly includes a feeding means on the machine for feeding the length of strap from which the loop is formed around the object. The assembly also includes a take-up means for taking up slack in the strap loop, and the take-up means is mounted on the machine in spaced relation to the feeding means.

A high tension member is mounted for rotation on the machine generally between the feeding means and the take-up means. The high tension member defines a slot for accommodating the strap extending between the feeding means and the take-up means. The high tension member defines a strap engaging surface on the periphery of the high tension member at an end of the slot. Means are provided for rotating the high tension member to engage and pull the strap for applying high tension to the strap loop.

In the disclosed method, the strap is initially directed in a path extending between the strap feeding means and the strap take-up means, and the strap is located in the high tension member slot. The strap is then engaged with the strap feeding means to feed a length of the strap which is formed into the loop. The end of the strap in the loop is then gripped, and the feeding means is disengaged before, during, or after gripping the strap end.

While continuing to grip the strap end, the strap is engaged with the take-up means to take up slack in the strap, and the high tension member is then rotated to engage and pull strap for applying high tension to the strap.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a simplified perspective view of a strapping machine embodying the novel strap feeding and tensioning apparatus disclosed herein for operation in accordance with the novel method disclosed herein;

FIG. 2 is a greatly enlarged, fragmentary, simplified, perspective view of the strap feeding and tensioning assembly operating to feed the strap forward to form a loop;

FIG. 3 is a reduced, front elevational view of the feed wheel and first pinch roll;

FIG. 4 is a reduced, front elevational view of the take-up wheel and second pinch roll;

DESCRIPTION OF THE PREFERRED EMBODIMENT

Figure 5:
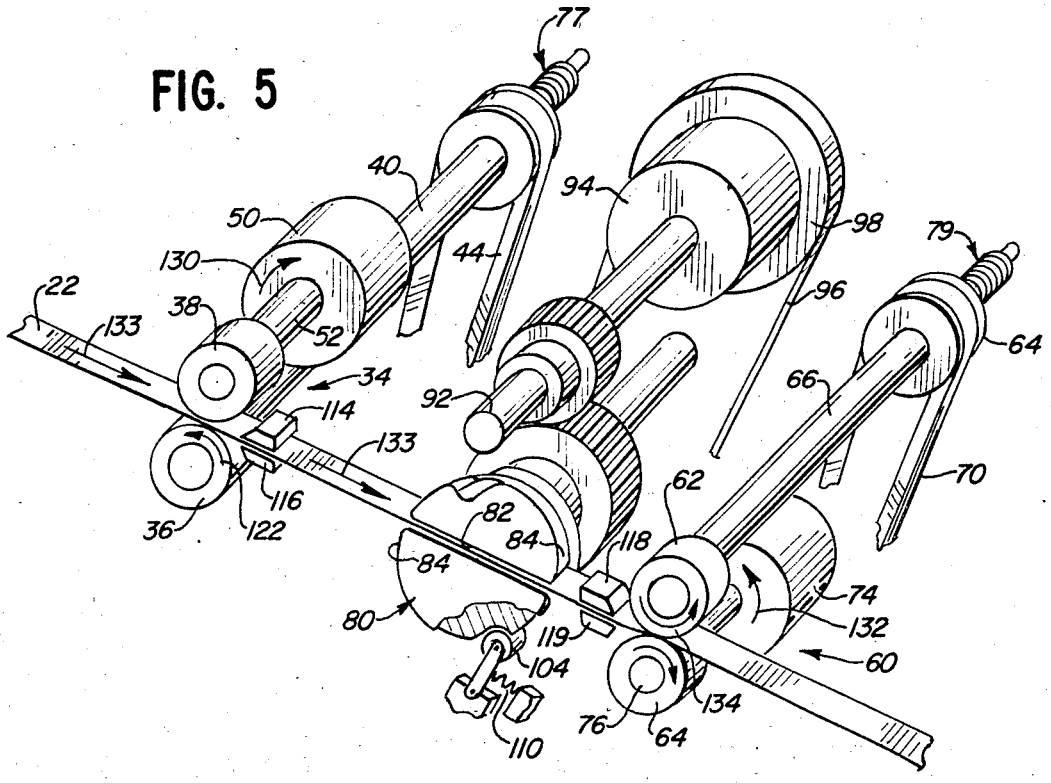
FIG. 5 is a view similar to FIG. 2 but showing the strap feeding and tensioning assembly operating to withdraw the strap.

While this invention is susceptible of embodiment in many different forms, this specification and the accompanying drawings disclose only one specific form as an example of the use of the invention. The invention is not intended to be limited to the embodiment so described, and the scope of the invention will be pointed out in the appended claims.

For ease of description, the disclosed novel apparatus is described in the normal (upright) operating position, and terms such as upper, lower, horizontal, etc., are used with reference to this position. It will be understood, however, that the novel apparatus may be manufactured, stored, transported, used, and sold in an orientation other than the position described.

The disclosed novel apparatus is adapted to be used in a strapping machine with certain conventional components the details of which, although not fully illustrated or described, will be apparent to those having skill in the art and an understanding of the necessary functions of such components.

Some of the figures illustrating the apparatus show structural details and mechanical elements that will be recognized by one skilled in the art. However, the detailed descriptions of such elements are not necessary to an understanding of the invention, and accordingly, are not herein presented.

Referring now to the drawings, the novel feeding and tensioning apparatus may be incorporated in an automatic strapping machine 20 as shown in its entirety in FIG. 1. Strap 22 is fed to the machine 20 from a dispenser 24 through an accumulator 26. The dispenser 24 and accumulator 26 may be of a special or conventional design.

A conventional dispenser is disclosed in the U.S. Pat. No. 3,602,452. Another type of conventional dispenser is employed, along with an accumulator, in the power strapping machines sold in the U.S.A. under the designations ML2-EE, ML2-JE, and ML2-HG by Signode Corporation, 3600 West Lake Avenue, Glenview, Ill. 60025, U.S.A. and is described in the "OPERATION, PARTS AND SAFETY MANUAL" for such machines as published by Signode Corporation under the designation "186152 REV 9/84". The use of an accumulator and/or dispenser per se is not necessary to the invention described and claimed herein, and the specific details of the dispenser 24 and accumulator 26 form no part of the present invention.

The strap 22 is fed through a lower housing 28 of the machine 20 and around a strap guideway or chute 30 on top of the housing 28. The housing 28 defines an object receiving station in which is placed the object (not illustrated) that is to be bound with the strap 22. The chute 30 may be of a special design or may be of a conventional design. Conventional chute designs are disclosed in the West German patent Auslegeschrift 1 211 102 and in the U.S Pat. No. 3,060,840. Another conventional chute design is incorporated in the power strapping machine marketed in the U.S.A. under the designation "MCD 700/300" by Signode Corporation, 3600 West Lake Avenue, Glenview, Ill. 60025 U.S.A., and is disclosed in the "OPERATION, PARTS AND SAFETY MANUAL" for that machine as published by Signode Corporation under the document designation "186161 Rev. 3/84". The detailed design and specific structure of the chute 30 incorporated in the machine 20 described herein forms no part of the present invention.

The disclosed strap feeding and tensioning method and apparatus may also be employed in a strapping machine that does not have a chute. In such machines, a length of the strap is initially fed, and the length of strap is then manually formed into a loop about the object.

In the lower housing 28 of the machine 20 there are appropriate strap end gripping and sealing mechanisms (not illustrated). Such mechanisms grip the end of the strap after the loop is formed. Then, after tensioning, such gripping and sealing mechanisms secure the overlapping strap portions together by melting and resolidifying regions of the overlapping strap portions. The strap gripping and sealing mechanisms may be of a special design or may be of a conventional design.

Conventional strap gripper and sealing assembly designs are disclosed in the U.S. Pat. Nos. 4,011,807 and 4,050,372. Another type of conventional strap gripping and sealing mechanism is employed in the power strapping machine marketed in the U.S.A. under the designation "MCD 700/300" by Signode Corporation, 3600 West Lake Avenue, Glenview, Ill. 60025 U.S.A., and is disclosed in the "OPERATION, PARTS AND SAFETY MANUAL" for that machine as published by Signode Corporation under the document designation "186161 Rev. 3/84". The detailed design and specific structure of the strap gripper and sealing mechanisms incorporated in the machine 20 described herein form no part of the present invention.

The strap feeding and tensioning assembly which is operable in accordance with the teachings of the present invention in the strapping machine 20 is located in the machine lower housing 28 below the chute 30 and generally in the region identified by the phantom line circle 33 in FIG. 1.

The strap feeding and tensioning assembly components are illustrated in FIGS. 2–6. For clarity, and for ease of illustration, the conventional support housing and mounting structures (e.g., conventional bearings), which hold the components in the illustrated positions, have not been shown.

Referring first to FIG. 2, which shows the components operating to feed the strap 22 forward into the chute 30, there is provided a feeding means 34 for feeding the strap 22 in the direction of the arrow 35 to form the loop. In the preferred embodiment illustrated in FIG. 2, the feeding means 34 includes a rotatable feed wheel 36 and a first pinch roll 38. The feeding means 34 further includes means for rotating the feed wheel 36, and this comprises, in the preferred embodiment, a shaft 40 on which the feed wheel 36 is mounted, a pulley 42 mounted on the shaft 40, a drive belt 44 trained around the pulley 42, and a suitable drive means (not illustrated) such as a motor, for rotating the drive belt 44.

The first pinch roll 38 is mounted for rotation adjacent the feed wheel 36 to accommodate the strap 22 between the feed wheel and the first pinch roll 38. A first strap pressing means 48 is provided on the machine for effecting relative movement between the rotating feed wheel 36 and the first pinch roll 38. This movement occurs between a first position (FIGS. 2 and 3 (solid lines only)) in which the strap 22 is pressed between the rotating feed wheel 36 and the first pinch roll 38 to feed the strap to form the loop around the object and a second position (FIGS. 5 and 6 (and phantom lines in FIG. 3)) in which the strap 22 is not pressed between the feed wheel 36 and the first pinch roll 38.

In the preferred embodiment illustrated, the first strap pressing means 48 includes a conventional electric rotary solenoid 50 having a shaft 52 on which the first pinch roll 38 is rotatably mounted. The shaft 52 is offset from the axis of rotation of the rotatable portion of the solenoid 50 to provide an eccentric motion (in the directions of double-headed arrow 54 in FIG. 3). The solenoid 50 is operable in the well-known manner to effect a rotation (e.g., through an arc of, say, 120 degrees) so as to move the pinch roll 38 between the first position illustrated in solid lines in FIGS. 2 and 3 and the second position illustrated in phantom lines in FIG. 3 and in solid lines in FIGS. 5 and 6.

With continued reference to FIG. 2, it can be seen that there is a take-up means 60 mounted on the machine in spaced relation to the feeding means 34. The take-up means 60 is provided for taking up slack in the strap loop, and in the preferred embodiment illustrated, includes a rotatable take-up wheel 62 and a second pinch roll 64 mounted for rotation adjacent the take-up wheel 62. The strap 22 is accommodated between the take-up wheel 62 and the second pinch roll 64. Whereas the first pinch roll 38 and feed wheel 36 are mounted above and below the strap 22, respectively, the second pinch roll 64 and take-up wheel 62 are mounted below and above the strap 22, respectively.

Means are provided for rotating the take-up wheel 62 in the direction opposite to the rotation of the feed wheel 36 and, in the preferred embodiment, such means include a shaft 66 on which the take-up wheel 62 is mounted, a pulley 68 mounted on the shaft 66, a belt 70 trained around the pulley 68, and a suitable drive means (not illustrated), such as a motor, for rotating the belt 70.

As with the feeding means 34, the take-up means 60 includes a strap pressing means 72 for effecting relative movement between the take-up wheel 62 and the second pinch roll 64. This movement occurs between a first position (illustrated in phantom lines in FIG. 4 and in solid lines in FIG. 5) in which the strap is pressed between the rotating take-up wheel 62 and the second pinch roll 64 to take up slack in the strap loop and a second position (illustrated in solid lines in FIGS. 2 and 4) in which the strap 22 is not pressed between the take-up wheel 62 and the second pinch roll 64.

In the preferred embodiment, the strap pressing means 72 includes a conventional electric rotary solenoid 74 having a shaft 76 offset from the axis of rotation of the rotating portion of the solenoid 74 so as to effect an eccentric motion of the shaft 76 and second pinch roll 64. Typically, the electric rotary solenoid 74 is operable to rotate the shaft 76 and second pinch roll 64 through an arc of, say, 120 degrees, in the directions of the double-headed arrow 78 as shown in FIG. 4 to move the second pinch roll 64 between the first position in which the strap is pressed against the take-up wheel 62 and the second position in which the strap is not pressed against the take-up wheel 62.

A high tension member 80 is mounted for rotation on the machine 20 generally between the feeding means 34 and the take-up means 60. The high tension member 80 defines a slot 82 to accommodating the strap 22 extending between the feeding means 34 and the take-up means 60.

The high tension member 80, in the preferred embodiment illustrated, has a generally cylindrical configuration, and the slot 82 has a substantially straight orientation on a diameter of the cylinder.

The high tension member 80 also defines a strap engaging surface 84 on the periphery of the member 80. It is not necessary that the strap engaging surface 84 include the entire cylindrical periphery of the rotatable high tension member 80. However, the strap engaging surface 84 is preferably defined on the periphery of the high tension member 80 on at least one end of the slot 82.

The high tension member 80 is mounted on a shaft 86 along with a gear 88. Both the gear 88 and high tension member 80 are keyed to the shaft for rotation with the shaft 86.

The gear 88 meshes with a gear 90 carried on another shaft 92 which is driven through an electrically actuated slip clutch 94 by a drive belt 96. A suitable means (not illustrated), such as an electric motor, is provided for rotating the drive belt 96.

The electric clutch 94 may be of the conventional type having (1) an input armature portion that continuously freely rotates on shaft 92, (2) an output rotor keyed to shaft 92, and (3) a stationary field and coil assembly which can be energized at a predetermined voltage level to engage the input armature face with the output rotor face so as to effect rotation of shaft 92.

One conventional clutch suitable for use as clutch 94 is that clutch sold in the U.S.A. under the designation "SEC-42C" by Electroid Company, 45 Fadem Road, Springfield, N.J. 07081 U.S.A. The details of the clutch design and operation form no part of the present invention.

The clutch 94 can be energized to a predetermined voltage level for transmitting the desired maximum torque. When the clutch output torque reaches the desired maximum torque, the clutch 94 slips. As explained in detail hereinafter, the rotation of the shaft 92, as effected through the energized clutch 94, is effective to rotate the high tension member 80 for applying high tension to the strap loop. Upon reaching the desired high tension level, the clutch 94 slips, but the high tension level is maintained during the slippage.

Slippage of the clutch 94 results in a decrease in the rate of rotation of the shaft 92. This can be sensed by conventional proximity sensors (not illustrated) in an appropriate control system which functions to (1) initiate the gripping and sealing of the overlapping portions of strap in the tensioned loop, and (2) de-energize the clutch 94. The detailed design and operation of such a control system form no part of the present invention.

Some or all of the gears 88 and 90, shafts 86 and 92, clutch 94, pulley 98, and belt 96 may be replaced by any suitable special or other conventional system for effecting rotation of the high tension member 80 in the manner described in detail hereinafter.

It is desirable to ensure the proper positioning of the rotatable high tension member 80 for receiving the strap 22 during the feeding and initial loop tightening steps. To this end, a detent mechanism is provided, and this includes at least one recess 102 in the periphery of the member 80. A roller 104 is provided for being received in one of the recesses 102. The roller 104 is mounted for rotation on a link 106 which is pivotally mounted to a support block 108. The roller 104 is normally biased against the high tension member 80 by a compression spring 110 acting between the link 106 and a support 112.

Two recesses 102 may be provided in a 180° spaced-apart relationship on the periphery of the rotatable high tension member 80. Although only one of the two recesses 102 would normally be effective to engage the roller 104, the provision of two such recesses 102 permits the rotatable high tension member 80 to be initially installed on the shaft 86 in either of two positions oriented 180° from each other.

Preferably, both the feeding means 34 and the take-up means 60 include a torque-limiting slip clutch, such as a mechanical spring clutch 77 on shaft 40 associated with the feed wheel 36 and a mechanical spring clutch 79 on the shaft 66 associated with the take-up wheel 62. Clutch 77 is conventionally mounted between the drive belt pulley 42 and the shaft 40. Similarly, clutch 77 is conventionally mounted between the drive belt pulley 68 and the shaft 66. Each clutch is adjustable, by means of a conventional spring adjustment, to slip and terminate rotation of the shaft when the torque required for rotation exceeds a predetermined amount of torque. The usefulness of this feature is described in detail hereinafter.

Upper and lower guide blocks 114 and 116, respectively, may be provided adjacent the feeding means 34 as illustrated in FIG. 2 for guiding the strap between the first pinch roll 38 and the feed wheel 36. Similarly, upper and lower guide blocks 118 and 119, respectively, may be provided adjacent the take-up means 60 for guiding the strap 22 between the second pinch roll 64 and the take-up wheel 62. The guide blocks serve to keep the strap 22 properly aligned, especially when the high tension member 80 is rotated to apply high tension as described in detail hereinafter.

The novel method for feeding and tensioning the strap 22, as effected with the above-described components, will next be described. Initially, the strap 22 is threaded in a path extending between the strap feeding means 34 and the strap take-up means 60 as illustrated in FIG. 2. The strap 22 is located in the slot 82 of the rotatable high tension member 80. The rotatable high tension member 80 is initially maintained with the slot 82 oriented as illustrated in FIG. 2 by means of the roller 104 biased by the spring 110 into the recess 102 of the high tension member 80.

Next, as illustrated in FIG. 2, the solenoid 50 is energized to swing the first pinch wheel 38 downwardly (arrow 54 in FIG. 3) to force the strap 22 against the feed wheel 36. The feed wheel 36 is preferably continuously rotating in the direction of arrow 122 in FIG. 2. The strap 22 is thus fed forwardly in the direction of arrow 35 (FIG. 2) to form the loop around the object.

When the free end of the strap 22 has traveled around the chute 30 and overlapped a trailing portion of the strap, the free end of the strap is gripped by conventional means (not illustrated). The conventional strap end gripping means may be actuated by suitable timers or strap end sensing mechanisms (not illustrated) which are conventional and well-known in the art. The details of such strap end gripper mechanisms, gripper actuating mechanisms, and gripper control systems form no part of the present invention.

The strap feeding step can be terminated before, during, or after the strap end is gripped. If the strap feeding is terminated after the strap end is gripped, the strap end would tend to buckle. Such strap buckling would also occur if the strap end hit an obstruction in the strap feeding path or chute. In either case, the present invention accommodates such an occurrence.

Specifically, the feed wheel 36 and first pinch roll 38 each have a generally smooth, strap-contacting surface. When the strap 22 encounters resistance to forward motion, as when the strap hits an obstruction or when the strap end is gripped in the chute, the feed wheel 36 slips relative to the strap 22, and the feeding of the strap 22 is terminated during the slippage.

This slippage phenomenon has been found to occur very quickly after the strap 22 encounters the resistance. Even with strap feeding speeds as high as 20 feet per second, the strap feed wheel 36 can slip sufficiently soon after increased strap feeding resistance occurs so that excessive buckling and crinkling of the strap end is avoided.

If the resistance is removed from the strap path, the strap feed wheel 36 again functions to feed the strap 22 forward. If the strap obstruction is not removed, or if the strap end has been gripped in the strap chute by a conventional gripper mechanism, then suitable timer systems may be provided for de-energizing the first pinch roll solenoid 50 which, under its internal spring force, moves the first pinch roll 38 to the elevated position wherein the strap 22 is no longer pressed between the feed wheel 36 and the first pinch roll 38. Movement of the rotary solenoid 50 to release the strap 22 is illustrated in FIG. 5 wherein the solenoid 50 has carried the first pinch roll 38 upwardly in the direction of the arrow 130.

When the first pinch roll 38 is spaced away from both the feed wheel 36 and strap 22 as illustrated in FIG. 5, the feed wheel 36 may continue rotating in the feeding direction as indicated by the arrow 122. Since the feed wheel 36 is no longer in contact with the strap 22 (the strap 22 assuming the position illustrated in phantom lines in FIG. 3), continued rotation of the feed wheel 36 cannot serve to transmit any feeding force to the strap 22. A more simplified, and more efficient, system results from such a continuous rotation of the feed wheel 36 through all steps of the strapping operation.

In any event, after the strap loop has been formed, after the strap end has been gripped, and after the first pinch roll 38 has been moved away from the strap 22, the loop may be rapidly tightened about the object to be bound. To rapidly tighten the loop around the object, the take-up means 60 is engaged with the strap. To this end, the rotary solenoid 74 is actuated to move the second pinch roll 64 upwardly in the direction of the arrow 132 (FIG. 5). The second pinch roll 64 thus assumes the position illustrated in phantom lines in FIG. 4 and presses the strap 22 against the take-up wheel 62. The take-up wheel 62, which is already rotating (in the direction of arrow 134 in FIG. 5) acts to retract the strap 22 at a relatively high rate of speed (e.g., 20 feet per second) in the direction of arrow 133 (FIG. 5).

As the strap 22 is pulled tight around the package, the resistance to further retraction of strap 22 is immediately transmitted as an increased tension force along the strap 22 to the feed wheel 62. The clutch 79, connected between the take-up drive pulley 64 and the shaft 66, slips when the torque required for further rotation exceeds a predetermined amount of torque. This will prevent the application of large transient forces (spike loading) on the object being bound with the strap when the strap has been drawn tight around the object. The clutch 79 will slip and keep a predetermined amount of the tension force on the strap 22 until the high tension sequence is initiated.

Figure 6:
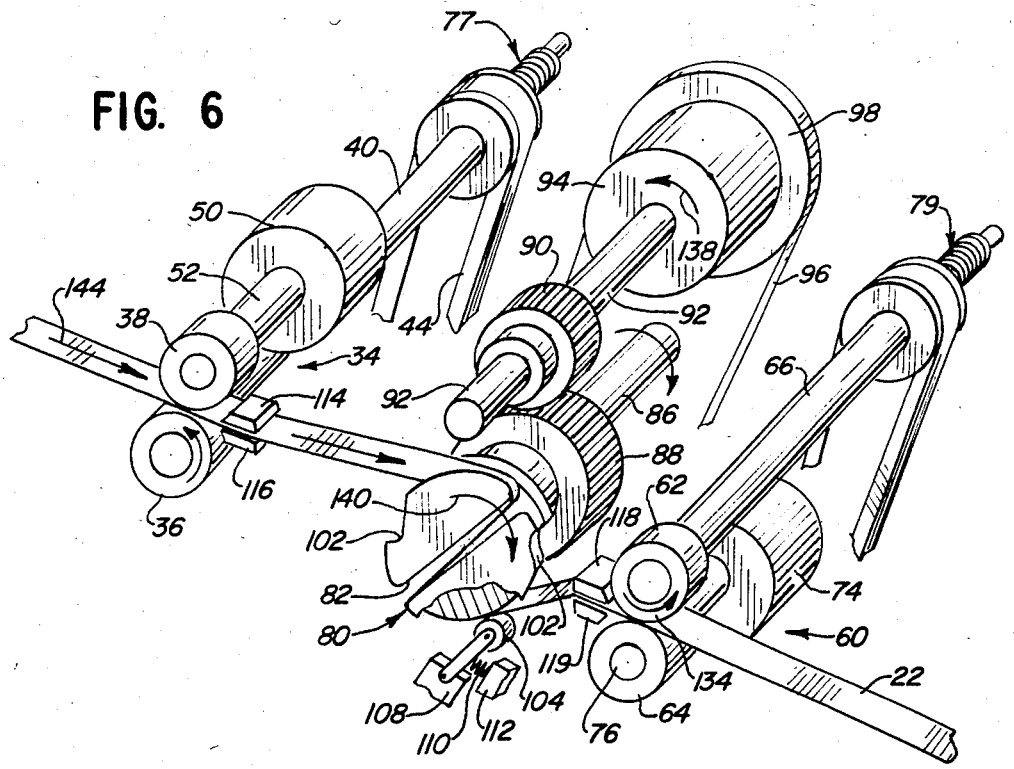
FIG. 6 is a view similar to FIGS. 2 and 5 but showing high tension being applied to the strap.

The high tension sequence is illustrated in FIG. 6. The sequence may be initiated by a variety of conventional controls, such as timers, tension switches, etc. The details of the specific initiating control system form no part of the present invention.

The initiation of the high tension sequence results in energizing the clutch 94 to effect rotation of the shaft 92 in the direction of the arrow 138 (FIG. 6). The drive torque, being transmitted through gears 90 and 88, causes rotation of the high tension member 80 in the direction of the arrow 140 (FIG. 6). The applied torque is sufficient to displace the detent roller 104 and to further retract the strap 22 in the direction of the arrow 144 (FIG. 6).

During the application of the high tension, the strap 22 is contacted by the strap engaging surfaces 84 at the ends of the high tension member slot 82. The strap 22 is thus gripped and pulled rearwardly to apply high tension to the package.

The portion of the strap 22 between the high tension member 80 and the take-up means 60 is pulled forwardly from between the take-up wheel 62 and second pinch roll 64. The mechanical clutch 79 and/or slippage of the strap between the second pinch roll 64 and take-up wheel 62 accommodate this action.

The electrically actuated clutch 94 is set, as discussed hereinbefore, to slip at a predetermined torque level corresponding to the amount of high tension force to be applied by member 80 to strap 22. The clutch 94 is then de-energized after the desired high tension has been reached and after the overlapping strap portions in the tensioned loop have been joined together by suitable means (not illustrated). The clutch 94 may also be de-energized before the overlapping strap portions are joined together if both overlapping strap portions are appropriately restrained under high tension prior to being joined together.

An appropriate control system, such as one including proximity switches for sensing decreased shaft rotation rates as described hereinbefore, may be provided for initiating the gripping and sealing of the overlapping strap loop portions and for de-energizing the electric clutch 94. The specific details of such a control system form no part of the present invention.

The portion of the strap 22 trailing the tensioned loop may be severed, by suitable conventional means (not illustrated), after the high tension has been applied by the high tension member 80. Depending upon the operation of the particular strap gripping and joint forming mechanisms (not illustrated), which may be conventional or special, the strap may be severed before, during, or after the strap loop is sealed.

In any event, once the high tension member clutch 94 has been de-energized, the clutch 94 is in the fully disengaged state so that there is substantially no retraction force being applied to the strap 22 by the high tension member 80. At the same time, the take-up means rotary solenoid 74 is de-energized to disengage the strap 22. The second pinch roll 64 is moved downwardly, by the internal spring force of the solenoid 74, to the disengaged position illustrated in FIGS. 2 and 4.

At this point, the rotatable tension member 80 is free to rotate back to its initial position. To this end, the rotary solenoid 50 is energized to move the first pinch roll 38 against both the strap 22 and the rotating feed wheel 36. In this position (FIG. 2), the rotating feed wheel 36 feeds the strap 22 forward and pulls the high tension member 80 back into the initial position (FIG. 2). The detent roller 104 is biased into the recess 102 to stabilize the position of the high tension member 80.

As the feed wheel 36 again feeds the strap 22 forward and pulls the high tension member 80 into the initial strap feeding orientation, the inertia of the high tension member 80 must be initially overcome. Since the strap feed wheel 36 is typically rotating continuously at a relatively high rate of speed, it is desirable to avoid applying an excessively high tension force to the strap 22. To this end, the clutch 77 limits the amount of torque that can be applied by the strap feed wheel 36 on the strap 22. An appropriate setting of the torque limit on the clutch 77 will permit some slippage as the feed wheel 36 initially acts on strap 22 to overcome the inertia of the high tension member 80. Such slippage permits the high tension member 80 to be pulled more gradually back to its initial strap feeding position (FIG. 2) without subjecting the strap 22 to excessively high tension forces.

The clutch 77 may also function to permit slippage of the strap feed wheel 36 at other times during the strap feeding sequence. In particular, if excessive resistance is encountered in pulling the strap 22 into the machine, as from the accumulator 26 and/or dispenser 24 (or any other supply means), then the clutch 77 will slip and prevent undue force from being applied to the strap 22.

Similarly, if the strap 22 encounters some obstruction in the strap chute 30 or in any part of the strap feed path, and if the obstruction creates a sufficiently high resistance to further strap feeding, the clutch 77 can slip to prevent buckling, crinkling, or jamming of the strap 22. This may supplement the slipping action, previously described, of the smooth surface feed wheel 36 and first pinch roll 38 that can occur in the same situation.

Preferably, the feed wheel 36 and the associated first pinch wheel 38, as well as the take-up wheel 62 and its associated second pinch roll 64, each have a relatively smooth surface. Thus, should any slippage occur between the strap 22 and the rotating surfaces engaged with the strap, undesirable abrasion ("milling") of the strap will not occur or will at least be substantially reduced.

The novel strap feeding and tensioning method and apparatus described herein is effective to feed and tension strap at relatively high rates of speed. Further, obstructions in the strap path are accommodated in a manner that prevents or substantially reduces the amount of buckling or crinkling of the strap.

The basic steps of the strapping process—initially feeding the strap to form the loop, then tightening the strap about the object, and finally applying high tension to the strap loop—can be effected relatively rapidly and efficiently. Excessive strap tension loads, as well as undesired transient peak loads on the object being bound, can be avoided. Further, potentially damaging abrasion or milling of the strap during the automatic feeding and take-up sequences is eliminated or substantially reduced.

The foregoing specification and the drawings are intended as illustrative of this invention and are not to be taken as limiting. Still other variations of the method and apparatus are possible without departing from the spirit and scope of the present invention.

What is claimed is:

1. A strap feeding and tensioning assembly for a strapping machine in which a length of strap can be formed into a loop about an object and in which there are means for gripping the end of the strap in the loop, said assembly comprising:

(a) feeding means on said machine for feeding a length of said strap from which said loop is formed around said object;

(b) take-up means for taking up slack in said strap loop, said take-up means being mounted on said machine in spaced relation to said feeding means;

(c) a high tension member mounted for rotation on said machine generally between said feeding means and said take-up means, said high tension member defining a slot for accommodating said strap extending between said feeding means and said take-up means, said high tension member defining a strap engaging surface on the periphery of said high tension member at an end of said slot; and (d) means for rotating said high tension member to engage and pull said strap for applying high tension to said strap loop.

2. The assembly in accordance with claim 1 in which said high tension member rotating means includes a rotating drive member for rotating said high tension member and a clutch for engaging said high tension member with said rotating drive member.

3. The assembly in accordance with claim 1 in which said high tension member slot is generally straight and in which said machine has a chute for guiding a length of said strap to form said loop.

4. In a strapping machine for providing a length of strap to be formed into a loop about an object and for gripping the end of the strap, a strap feeding and tensioning assembly comprising:

(a) a rotatable feed wheel mounted to said machine and means for rotating said feed wheel;

(b) a first pinch roll mounted to said machine for rotation adjacent said feed wheel to accommodate said strap between said feed wheel and said first pinch roll;

(c) first strap pressing means on said machine for effecting relative movement between said rotating feed wheel and said first pinch roll between (1) a first position in which said strap is pressed between said rotating feed wheel and said first pinch roll to feed said length of strap from which said loop is formed around said object and (2) a second position in which said strap is not pressed between said feed wheel and said first pinch roll;

(d) a rotatable take-up wheel mounted to said machine in spaced relation to said feeding means and means for rotating said take-up wheel in a direction opposite to the feed wheel rotation;

(e) a second pinch roll mounted to said machine for rotation adjacent said take-up wheel to accommodate said strap between said take-up wheel and said second pinch roll;

(f) second strap pressing means on said machine for effecting relative movement between said take-up wheel and said second pinch roll between a first position in which said strap is pressed between said rotating take-up wheel and said second pinch roll to take up slack in said strap loop and a second position in which said strap is not pressed between said take-up wheel and said second pinch roll;

(g) a high tension member mounted for rotation on said machine generally between said feed wheel and said take-up wheel, said high tension member defining a slot for accommodating said strap extending between said feeding means and said take-up means, said high tension member defining a strap engaging surface on the periphery of said high tension member at an end of said slot; and (h) means for rotating said high tension member to engage and pull said strap for applying high tension to said strap loop.

5. The assembly in accordance with claim 4 in which each said feed wheel rotating means and said take-up wheel rotating means includes a torque-limiting slip clutch for terminating rotation when the torque required for rotation exceeds a predetermined amount of torque.

6. The assembly in accordance with claim 4 in which each said first strap pressing means includes a first rotary solenoid for moving said first pinch roll toward and away from said feed wheel and in which said second strap pressing means includes a second rotary solenoid for moving said second pinch roll toward and away from said take-up wheel.

7. A method for feeding and tensioning strap in a strapping machine in which a length of strap is provided for being formed into a loop about an object and in which the strap end is gripped to permit tensioning of the loop, said feeding and tensioning method comprising the steps of:

(a) directing said strap in a path extending between a strap feeding means for feeding said strap to form a loop and a strap take-up means for taking up slack in said strap loop and locating said strap in a slot defined in a rotatable high tension member that is disposed generally between said feeding means and said take-up means and that defines a strap engaging surface on the periphery of the high tension member at an end of the slot;

(b) engaging said strap with said feeding means to feed a length of said strap and forming said loop from said length of strap;

(c) gripping the end of said strap in said loop and disengaging said feeding means from said strap before, during, or after gripping said strap end;

(d) while continuing step (c), engaging said strap with said take-up means to take up slack in said strap; and (e) while continuing step (c), rotating said high tension member to engage and pull said strap for applying high tension to said strap.

8. The method in accordance with claim 7 in which step (d) is continued while effecting step (e).

9. The method in accordance with claim 7 in which said high tension member is rotatably engaged through an electric slip clutch having a maximum torque output and in which step (e) includes energizing said electric slip clutch to effect rotation of said high tension member.

10. The method in accordance with claim 9 in which step (e) further includes holding a desired high tension on said strap by means of the slipping of said electric slip clutch when the torque required for rotation of said high tension member exceeds a predetermined amount of torque.

11. The method in accordance with claim 10 including the further steps, after step (e), of clamping together the overlapping portions of strap in the loop and then de-energizing said electric slip clutch.

12. A method for feeding and tensioning strap in a strapping machine in which a length of strap is guided in a guideway to form a loop about an object and in which the strap end is gripped to permit tensioning of the loop, said feeding and tensioning method comprising the steps of:

(a) locating said strap in a path between a rotating feed wheel and an adjacent rotatable first pinch roll, between a rotating take-up wheel and an adjacent rotatable second pinch roll, and in a slot defined in a rotatable high tension member that is disposed generally between said feed wheel and said take-up wheel and that defines a strap engaging surface on the periphery of the high tension member at an end of the slot;

(b) effecting relative movement between said rotating feed wheel and first pinch roll to press said strap between said feed wheel and said first pinch roll for feeding a length of said strap in said guideway to form said loop from said length of strap;

(c) effecting relative movement between said rotating feed wheel and said first pinch roll to a second position for releasing the pressure on said strap from said feed wheel and said first pinch roll;

(d) gripping the end of said strap in said loop before, during, or after step (c);

(e) while continuing step (d), effecting relative movement between said rotating take-up wheel and said second pinch roll to press said strap between said take-up wheel and said second pinch roll for taking up slack in said strap; and (f) while continuing step (d), rotating said high tension member to engage and pull said strap for applying high tension to said strap loop.

13. The method in accordance with claim 12 in which step (f) also includes the step of temporarily terminating the rotation of said take-up wheel by disengaging a torque limiting slip clutch when the torque required for rotation exceeds a predetermined amount of torque.

* * * * *